US007036751B1

(12) United States Patent
Lund et al.

(10) Patent No.: US 7,036,751 B1
(45) Date of Patent: May 2, 2006

(54) PUMP OPERATED SPRAYING DEVICE

(75) Inventors: Bruce D. Lund, Chicago, IL (US); Michael Starrick, Maywood, IL (US); Krishnan Srirangam, Chicago, IL (US)

(73) Assignee: Lund and Company Invention, LLC, Chicago, IL (US)

( * ) Notice: Subject to any disclaimer, the term of this patent is extended or adjusted under 35 U.S.C. 154(b) by 191 days.

(21) Appl. No.: 10/734,886

(22) Filed: Dec. 15, 2003

(51) Int. Cl.

| | |
|---|---|
| ***A62C 13/62*** | (2006.01) |
| ***A62C 11/00*** | (2006.01) |
| ***B05B 7/30*** | (2006.01) |
| ***B05B 7/32*** | (2006.01) |

(52) U.S. Cl. ..... 239/302; 239/349; 239/351; 239/356; 239/360; 239/337

(58) Field of Classification Search ..... 239/302, 239/349, 351, 356, 360, 373, 93, 337, 332
See application file for complete search history.

(56) References Cited

U.S. PATENT DOCUMENTS

| | | | | |
|---|---|---|---|---|
| 4,544,336 | A * | 10/1985 | Faeser et al. | 417/412 |
| 4,720,249 | A * | 1/1988 | Krebs et al. | 417/477.8 |
| 5,173,038 | A * | 12/1992 | Hopfensperger et al. | 417/476 |
| 5,447,417 | A * | 9/1995 | Kuhl et al. | 417/477.11 |
| 6,321,941 | B1 * | 11/2001 | Argentieri et al. | 222/81 |
| 6,386,392 | B1 * | 5/2002 | Argentieri et al. | 222/81 |
| 6,560,806 | B1 * | 5/2003 | Lawson et al. | 8/158 |
| 6,578,224 | B1 * | 6/2003 | Lawson et al. | 8/158 |
| 6,595,437 | B1 * | 7/2003 | Lawson et al. | 239/119 |

* cited by examiner

*Primary Examiner*—Davis Hwu
(74) *Attorney, Agent, or Firm*—Much Shelist Freed Denenberg Ament & Rubenstein PC

(57) ABSTRACT

A water gun and a watering container using an electrically operated peristaltic pump for pumping water through a nozzle located at the end of a tube connecting a reservoir with an outlet opening. The pump is electrically controlled by a trigger mechanism in a handle of the gun or container. The gun also includes a rotating light arrangement indicating that the gun is in use.

5 Claims, 3 Drawing Sheets

PUMP OPERATED SPRAYING DEVICE

BACKGROUND OF THE INVENTION

Pump operated spraying devices of various kinds have been with us for a long time. This has included water guns, pump-operated window spraying mechanisms and numerous other types. However, there has long been a need for a single yet effective electrically operated device capable of cyclically ejecting a liquid through a nozzle opening that may or may not be adjustable. Two merely illustrative examples of where this novel concept can be applied are a toy gun and a watering container that are easy to handle and simple to operate.

SUMMARY OF THE INVENTION

There is herein described and illustrated a unique illuminated toy water gun and watering container that are electrically operated. The gun and watering container has all the appearance of devices of a similar nature and each utilizes a simple pumping system that has a long life. In both instances a peristaltic pump is employed which takes a very small space, is easy to operate, and is unique in its utilization with toy guns and watering containers.

Other advantages and features of the invention will become readily apparent from the following detailed description of the various embodiments of the invention, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
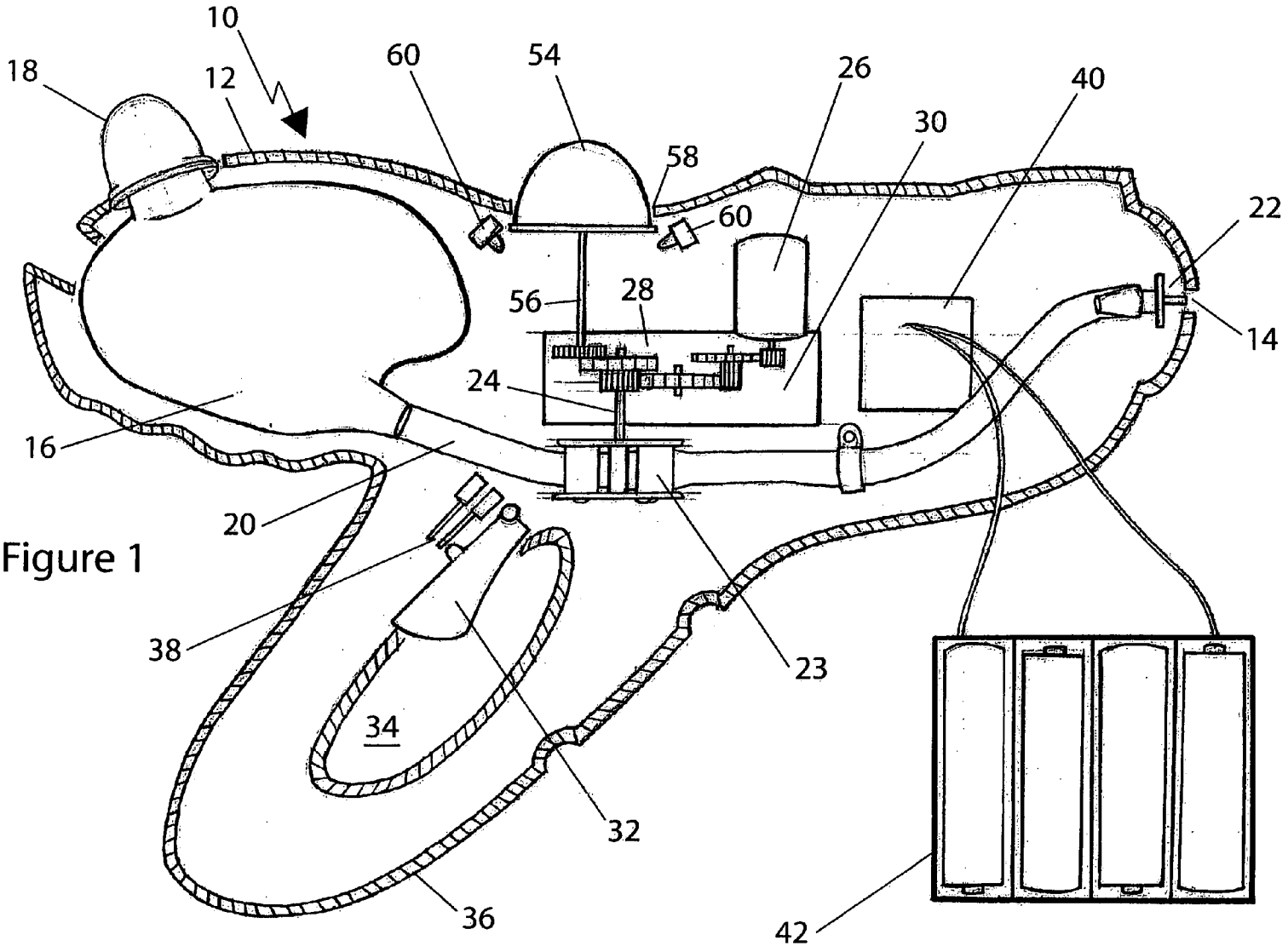
FIG. 1 is a cross-sectional view showing the internal components of the novel electrically operated toy water gun.

Referring first to FIG. 1 there is illustrated in cross-section the toy water gun 10 that includes a housing 12 having an outlet opening 14 through which water is ejected during the operation thereof.

The water gun includes a water reservoir 16 which has a cap 18. The reservoir 16 can be filled from any suitable source upon removing the cap 18 and after filling the cap will reseal the reservoir 16.

Leading from the reservoir 16 to the outlet opening 14 is a tube 20 having a nozzle 22 secured to its outer end adjacent opening 14. Water is pumped through the tube 20 by a peristaltic pump 23 when activated by a motor driven output shaft 24. The electrically driven motor 26 operates a gear drive 28 located in the gearbox 30. The operation of the motor 26 is controlled by a trigger 32 that extends into a housing opening 34 in the handle portion 36 of the gun housing 12. The trigger 32 is normally biased into the inactive position shown in FIG. 1 by a conventional spring biased arrangement. In the position shown in FIG. 1 the trigger 32 is out of contact with contact points 38 that forms part of the electric circuit schematically illustrated at 40 for controlling the motor 26. The power source for the circuit is shown as the battery pack 42 containing 4 AA batteries. When the trigger 32 is pulled the contact points 38 are engaged to close the circuit and energize the motor 26. Energization of the motor drives the peristaltic pump 23 through the gear drive 28 and the output shaft 24.

Figure 3:
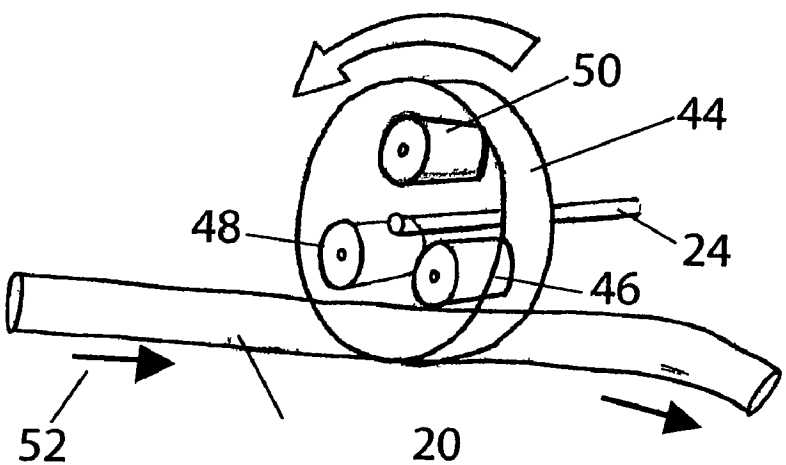
FIG. 3 shows the position of the pump wheel when the rotating rollers are out of contact with the tube.
Figure 2:
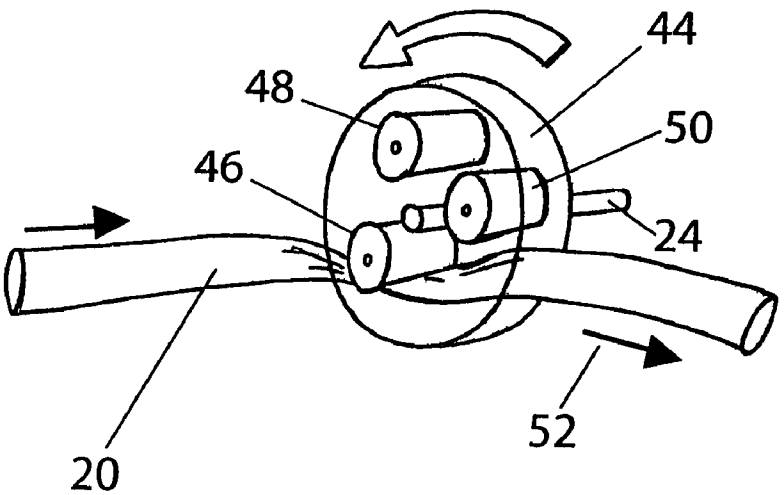
FIG. 2 is a schematic view of the peristaltic pump showing a roller in contact with the tube to force water forward in the tube.

Referring now to FIGS. 2 and 3 there is illustrated in schematic form the operation of the peristaltic pump 23. The pump 23 includes a pump wheel 44 with respect to which are secured 3 freely rotatably mounted rollers 46,48 and 50. The pump wheel 44 is rotated by the motor output shaft 24.

Upon rotation of the pump wheel 44 the rollers 46,48,50 are brought into sequential contact with the tube 20 to force a stream of water through the tube 20 and nozzle 22 and out the housing opening 14 to squirt water on its intended object such as another child.

FIG. 2 shows roller 46 pressing the tube 20 to force water in the direction of the arrows 52 and FIG. 3 shows the tube being released to admit water into the portion of the tube that has been evacuated by roller 46. The rotation of the wheel 44 and the sequential squeezing by the rollers 46,48,50 continues to force water out of the tube and through the nozzle 22 and outlet opening 14 until the reservoir is emptied.

In addition to the operation of the pump 23 by the motor 26 there is provided as shown in FIG. 1 a small decorative hemisphere 54 that is driven by a second output shaft 56. This hemisphere 54 extends through an opening 58 in the upper portion of the housing 12 and is illuminated by a small light emitting diode 60 located adjacent the hemisphere 58. The light emitting diode is part of the circuit 40 that is activated by the trigger 32.

Figure 4:
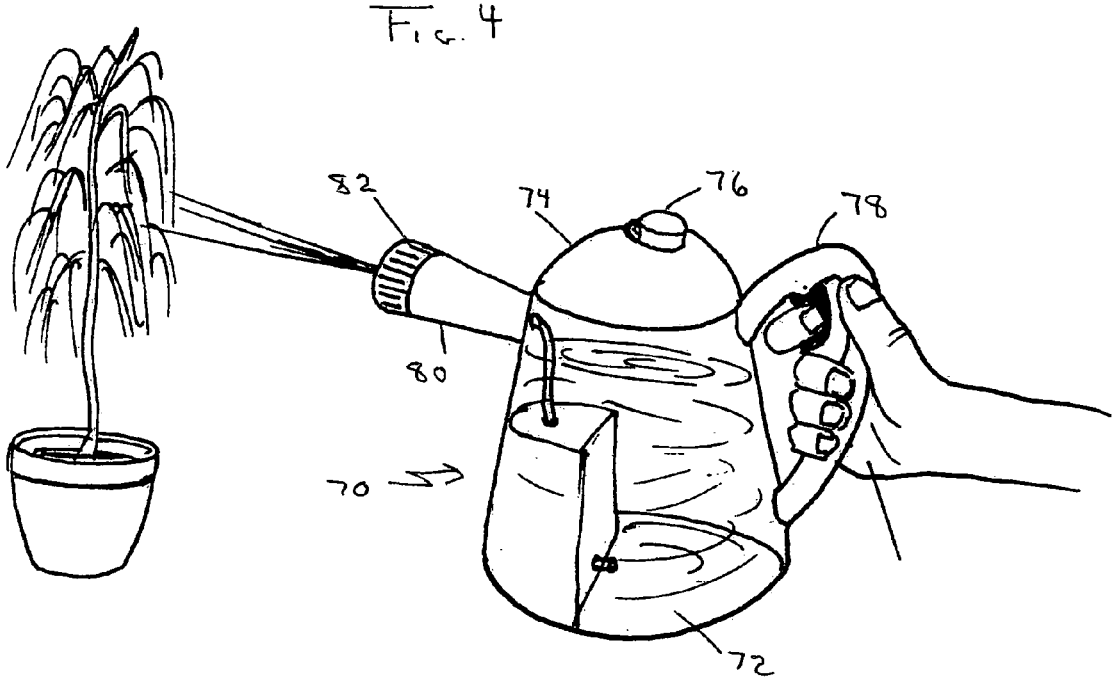
FIG. 4 is a perspective view of a novel electrically operated watering container employing a peristaltic pump for pumping water out of the container.
Figure 5:
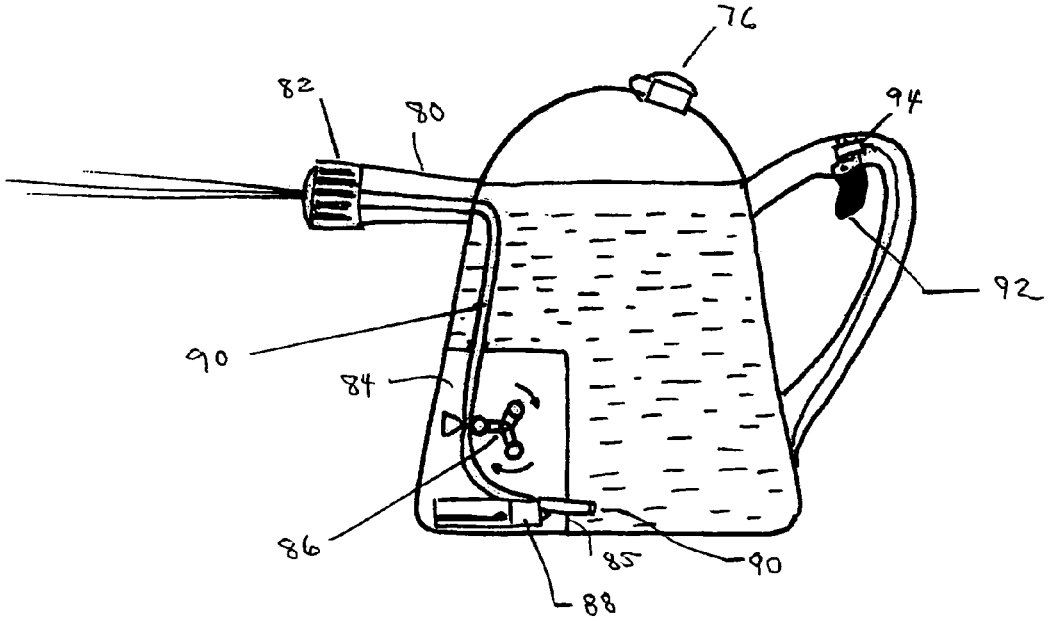
FIG. 5 is a cross-sectional view showing schematically the internal electrical and pumping components of the watering container.

Turning now to FIGS. 4 and 5 there will be described the various components of the electrically operated motorized watering container.

In FIG. 4 there is shown the watering container 70 including a main body portion 72 and a cover 74. The cover contains a cap 76 which can be opened to fill the watering container 70 from a suitable source.

The container includes a handle 78 and an outlet spout 80. The outlet spout 80 is controlled by a conventional adjustable spray nozzle 82. Located within the body portion is a sealed-off area 84 defined by a housing 85 in which is located the peristaltic pump 86 that is substantially identical to pump 23 shown in FIG. 1 and illustrated and described further in FIGS. 2 and 3. The pump is operated by a pump motor (not shown) supplied with power from batteries 88 generally as shown with respect to the water gun of FIG. 1. The pump acts on a silicone tube 90 that connects the bottom of the container 70 with the adjustable spray nozzle 82 at the outlet spout 80. The tube 90 extends through the housing 85 wherein it is engaged by the peristaltic pump 86 to push increments of water through the tube and out the spout 80 and adjustable nozzle 82. The tube 90 is suitably sealed with respect to the housing 85 to prevent water from coming into contact with the batteries, pump and motor, etc. located in housing 85.

The peristaltic pump 86 is controlled by a trigger 92 in the handle 78 that operates to open or close a switch 94. The switch is in the normally open position and when the trigger is pulled the switch is closed to operate the peristaltic pump to force water through the tube 90 and out the spray nozzle 82.

It is intended to cover by the appended claims all modifications that fall within the true spirit and scope of the invention.

What is claimed is:

1. A pump operated spray assembly comprising a housing defining an outlet opening, a water reservoir in said housing, a tube leading from said reservoir to said outlet opening, a peristaltic pump for pumping water in said tube through said outlet opening which pump consists of a pump wheel having three rotatably mounted rollers secured thereto, a motor assembly including a motor and a gear drive including a first output shaft for rotating said pump wheel and said rollers to sequentially compress said tube to pump water out of said outlet opening, a power supply for said motor, and a trigger-operated circuit for activating said power supply to control the motor assembly to squirt water out the outlet opening in said housing.

2. A pump operated spray assembly as set forth in claim 1 comprising a water gun having a small decorative hemisphere extending out of an opening defined by an upper portion of said housing and the gear drive includes a second output shaft for rotating said hemisphere and a light emitting diode controlled by said circuit and located adjacent said hemisphere to provide a flashing light within said hemisphere when said gun is operated.

3. A pump operated spray assembly as set forth in claim 1 comprising a watering container including a main body portion, a cover having an opening and a cap therefore, said container defining a sealed-off section in the bottom portion thereof, the sealed-off section includes the peristaltic pump, the motor assembly and the power supply for said motor, the tube leading from the bottom portion of the watering container extending through said sealed-off section where it engages the peristaltic pump and then connects to the outlet opening.

4. A watering container as set forth in claim 3 in which there is an adjustable nozzle secured in place in said nozzle opening.

5. A watering container as set forth in claim 3 in which the container further includes a handle portion and the trigger operated circuit includes a trigger located in said handle portion for activating said power supply.

* * * * *